United States Patent [19]

Hermann

[11] Patent Number: 5,042,613

[45] Date of Patent: Aug. 27, 1991

[54] SAFETY TRACER FOR FIRE FIGHTERS

[76] Inventor: Ronald W. Hermann, 3842 Breuner Ave., Sacramento, Calif. 95810

[21] Appl. No.: 604,137

[22] Filed: Oct. 29, 1990

[51] Int. Cl.[5] ..... A62B 37/00

[52] U.S. Cl. ..... 182/18; 182/230; 182/232

[58] Field of Search ..... 182/3, 18, 230, 232; 33/755, 756, 768

[56] References Cited

U.S. PATENT DOCUMENTS

| | | | |
|---|---|---|---|
| 310,675 | 1/1985 | Hall | 15/259 |
| 633,357 | 9/1899 | Caulfield | 182/235 |
| 939,375 | 11/1909 | Andrews | 182/232 |
| 1,010,544 | 12/1911 | Warner | 182/235 |
| 2,602,233 | 7/1952 | Irving | 33/756 |
| 4,161,266 | 7/1979 | Howarth | 224/215 |
| 4,273,215 | 6/1981 | Leggett | 182/3 |
| 4,642,898 | 2/1987 | Miller | 33/768 X |
| 4,877,110 | 10/1989 | Wolner | 182/232 |
| 4,942,943 | 7/1990 | Flaherty | 514/222.8 |

*Primary Examiner*—Carl D. Friedman

*Assistant Examiner*—Derek J. Berger

*Attorney, Agent, or Firm*—Thomas I. Rozsa

[57] ABSTRACT

A light, compact safety tracer carried by fire fighters comprising a novel attaching means for attaching an elongated cord to an object outside or at the entrance of a burning house or at the entrance to a room before a fire fighter conducts searching. As the fire fighter enters the house the fire retardant cord is extended out from the safety tracer clipped on the waist belt of the fire fighter. From the color code on the cord the fire fighter can tell how far he has gone inside. The attaching means is shaped as a wedge so if attached to the hinge of a door it will keep the door open. A light source on the attaching means informs other fire fighters that the room is being searched and a fire fighter is inside. The safety tracer is equipped with a pager so he can alert other fire fighters if he needs help or is in trouble. The extended cord will serve as a guide so even when the smoke is so thick that a fire fighter can not see through he can still easily and quickly find his way out. A slide razor is further mounted on the safety tracer in case the cord is caught to something and the fire fighter has to cut it off.

13 Claims, 2 Drawing Sheets

SAFETY TRACER FOR FIRE FIGHTERS

BACKGROUND OF THE INVENTION

1. Field of the Invention

The present invention relates to the field of safety equipment for fire fighters. During a fire, a fire fighter often has to enter a smoke filled house to search for victims. Sometimes the smoke becomes so thick that the fire fighter cannot see and find his way out. Before entering the structure, a fire fighter should have a safety rope, or "lifeline", tied to him at one end, with the other end of the line projecting outside the house so he can find his way out by following the rope. Unfortunately, the search is often performed in an emergency and the lifeline is rarely used. The present invention relates in particular to the field of safety devices for fire fighters used in searching through a structure during a fire.

2. Description of Prior Art

There are numerous types of safety equipment with lifelines for fire fighters known in the prior art. The most relevant prior art known to the inventor is represented by the following United States Patents:

1. U.S. Pat. No. 310,675 issued to Hall on Jan. 13, 1885 for "Fire Escape" (hereafter "Hall Patent").
2. U.S. Pat. No. 633,357 issued to Caulfield on Sept. 19, 1899 for "Fire Escape" (hereafter "Caulfield Patent").
3. U.S. Pat. No. 939,375 issued to Andrews on Nov. 9, 1909 for "Fire Escape" (hereafter "Andrews Patent").
4. U.S. Pat. No. 1,010,544 issued to Warner on Dec. 5, 1911 for "Fire Escape" (hereafter "Warner Patent").
5. U.S. Pat. No. 4,161,266 issued to Howarth on July 17, 1979 for "Lifeline Carrier" (hereafter "Howarth Patent").
6. U.S. Pat. No. 4,273,215 issued to Leggett on June 16, 1981 for "Safety Harness For Hunters" hereafter "Leggett Patent").
7. U.S. Pat. No. 4,877,110 issued to Wolner on Oct. 31, 1989 for "Safety Device With Retractable Lifeline" (hereafter "Wolner Patent").
8. U.S. Pat. No. 4,942,943 issued to Flaherty on July 24, 1990 for "Roofing Safety Device" (hereafter "Flaherty Patent").

The Hall Patent discloses a fire-escape comprising a frame, a reel pivoted on the frame, a cable wound around the reel, and a brake-lever pivoted also on the frame but below the reel, where one end of the brake-lever is bearing on the cable and the other end is connected to a belt fastened around a fire fighter's waist. The fire fighter can hang the cable onto a fixed object, and lower himself down by using the brake-lever to control the release of the cable.

The Caulfield Patent discloses a fire-escape comprising a drum, a cord wound around the drum, a friction-band encircling the drum and having at each end a link, a pulling device and a suspension-strap having one end attached to one link and passed freely through the other link and the other end fastened around a fire fighter's waist. The fire fighter can hang the cord onto a fixed object and lower himself down by using the pulling device to loosen the suspension-trap, thereby controlling the release of the cable.

The Andrews Patent discloses a fire-escape comprising a casing with two compartments, a reel mounted in one of the compartments, a spur wheel mounted in the other compartment, including a coil spring and geared with the reel by a pinion, a crank handle controlling the spur wheel, a cable wound on the reel and passing out of the casing and fastened back to the casing after passing through a pulley, and straps fastening a fire fighter to the casing. The fire fighter can hang the pulley to a fixed object, and lower himself down by using the crank handle to turn the reel to unwind the cable.

The Warner Patent discloses a fire escape comprising a frame, a drum with convex heads pivoted on the frame, a cable wound around the drum, a crank handle also pivoted on the frame and engaged to the drum with gears, a toggle lever with an intermediate pivot connected to the frame, a brake-controlling mechanism mounted on the frame and connected to the pivot, and a sling connected to the pivot and supporting a fire fighter. The fire fighter can hang the cable onto a fixed object, and lower himself down by using the crank handle to turn the drum to unwind the cable.

In all of the Hall Patent, the Caulfield Patent, the Andrews patent and the Warner Patent, the fire fighter's body weight is used as the descending force. The difference is the mechanism used to control the descending speed. Both the Hall Patent and the Caulfield Patent use some kind of braking mechanism which is engaged by the fire fighter's body weight and can be disengaged by the fire fighter, while the Hall Patent uses a point-friction braking mechanism and the Caulfield Patent uses a circumference-friction braking mechanism. The Andrews Patent does not have a braking mechanism but instead uses a crank handle to control the unwinding speed of the suspended cable. The Warner Patent also uses a crank handle, yet further uses a cam-friction braking mechanism which is also engaged by the fire fighter's body weight and can be disengaged by the fire fighter.

The Howarth Patent discloses a lifeline carrier comprising a container with an openable end, a closing hinge pivoted to the container at the openable end, an elongated line packed inside the container, and a blade mounted to the container which is used to attach the container to an air tank carried on the back of a fire fighter. The fire fighter can quickly release the packed line for use.

The Leggett Patent discloses a safety harness for hunters comprising a multiplicity of webs engaged to a gang connector, and a lifeline connected to the gang connector. It is particularly adapted for use by hunters who hunt from trees.

The Wolner Patent discloses a safety device with retractable lifeline comprising a housing, a drum pivoted inside the housing, a lifeline wound around the drum, a spring mechanism for biasing the drum to rotate in a retracting direction, a braking mechanism for braking extending rotation of the drum at an angular velocity in excess of some predetermined speed, and belts for fastening a person working at great heights. When the person falls, the lifeline is unwound from around the drum at a high speed which causes the drum to rotate at a high angular velocity, which in turn activates the braking mechanism. The braking mechanism will then stop the rotation of the drum to prevent further falling of the person. After each use the device must be serviced before used again because the braking mechanism is locked when somebody falls and will not self-release.

The Flaherty Patent discloses a roofing safety device comprising an upright support having self-braking mechanism and a cable assembly attached to the support. It is used for rooftop workers to secure themselves to prevent roofing injuries and death.

Overall, all the safety devices disclosed in the above discussed patents, except the lifeline container in the Howarth Patent, are used either for safely descending people from a higher place to a lower place or effectively preventing people from falling from dangerous heights. The lifelines are also designed to be heavy and strong so that they can support a person's full body weight. However in many cases when a fire fighter is working on just ground level these types of height related safety devices are really not necessary and the respective lifelines are also too heavy and time consuming to operate. In such situations, a less weighted lifeline is preferred, and the lifeline does not have to be associated with a device having a mechanism to manually control the releasing speed of the lifeline. The primary purpose of having a lifeline attached to a fire fighter fighting a fire on a ground level and within a structure is to provide him a tracer so he can use it to find his way back or others can use it to find him in case the smoke is too thick to see through. A new kind of safety device is needed to serve this purpose.

SUMMARY OF THE PRESENT INVENTION

The present invention is a safety tracer for fire fighters.

In numerous fire fighting situations a fire fighter often needs to enter a burning house to search for victims in different rooms. The house and the rooms are often filled with thick smoke so it is very hard for the fire fighter to see through. This is very dangerous for the fire fighter when he tries to find his way out because he can easily become lost in the thick smoke. A fire fighter is supposed to carry a lifeline with him to assist him in finding his way out. But traditional safety devices with lifelines are usually designed for preventing height related dangers so they are too heavy and too time consuming to operate, and further usually require at least one hand to control.

It has been discovered, according to the present invention, that it is not necessary to use a safety device designed to be able to carry the whole body weight of a fire fighter in searches conducted only in buildings on ground level, but nevertheless a lifeline is definitely needed. If a fire retardant cord with less weight is used as a lifeline to serve the purpose of tracing, then the housing for the lifeline can be smaller and lighter and even clipped on the waist belt of a fire fighter and carried around by the fire fighter all the time.

It has additionally been discovered, according to the present invention, that if the lifeline is further color coded every certain length, then when it is reeling out as a fire fighter goes further and further inside a house, the fire fighter is able to tell from the color of the cord at his end that how far he has entered a house.

It has further been discovered, according to the present invention, that a fire fighter often goes into and searches a burning house in a great hurry, so he needs to be able to tie the outside end of the lifeline to an object outside or at the entrance of the house, or entrance of a specific room in the house as quickly as possible. The traditional lifeline has a straight end which has to be tied to something, but it is not always easy to find something to which it can be tied in a hurry. If a clamp is connected to the outside end of the lifeline, then the fire fighter can connect the outside end of the lifeline much quicker and easier to almost anything outside or at the entrance of the house, or the entrance to the room within the structure, such as the hinge of a door, the door itself, the fire hose, a tree, or even furniture.

It has even further been discovered, according to the present invention, that if the clamp connected to the outside end of the lifeline is made to have a shape such as a wedge, then when clamped to the hinge of a door the clamp can hold the door open so it is easier for the fire fighter to exit.

It has furthermore been discovered, according to the present invention, that if the clamp is further equipped with a light, then it can inform other fire fighters that there is a fire fighter inside and that particular room is being searched already.

It has additionally been discovered, according to the present invention, that if the housing of the lifeline carried by a fire fighter is equipped with a pager, then the fire fighter can effectively alert other fire fighters outside when he needs help or is in trouble.

It has further been discovered, according to the present invention, that if the housing of the lifeline if further equipped with a cutter, then a fire fighter can easily cut loose the lifeline in case it gets caught on something and restricts the free move of the fire fighter.

It is therefore an object of the present invention to provide a safety tracer for fire fighters which comprises a light weight color coded fire retardant lifeline and a housing, wherein the lifeline can be unwound out from and wound back into the housing, and the small and light housing can be clipped on the waist belt of fire fighters.

It is an additional object of the present invention to provide a safety tracer for fire fighters which further comprises a wedge shaped clamp equipped with a light source connected to the outside end of the lifeline for a multiplicity of features such as easy and quick attaching of the lifeline, holding the attached door open, and indicating to other fire fighters that a fire fighter is inside and searching the room.

It is a further object of the present invention to provide a safety tracer for fire fighters which further comprises a pager and a cutter mounted on the housing wherein the pager can be used to alert others and the cutter can be used to cut off a stuck lifeline.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated: .

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deem to be within the spirit, scope and contemplation of the invention as further defined in the appended claims.

Figure 1:
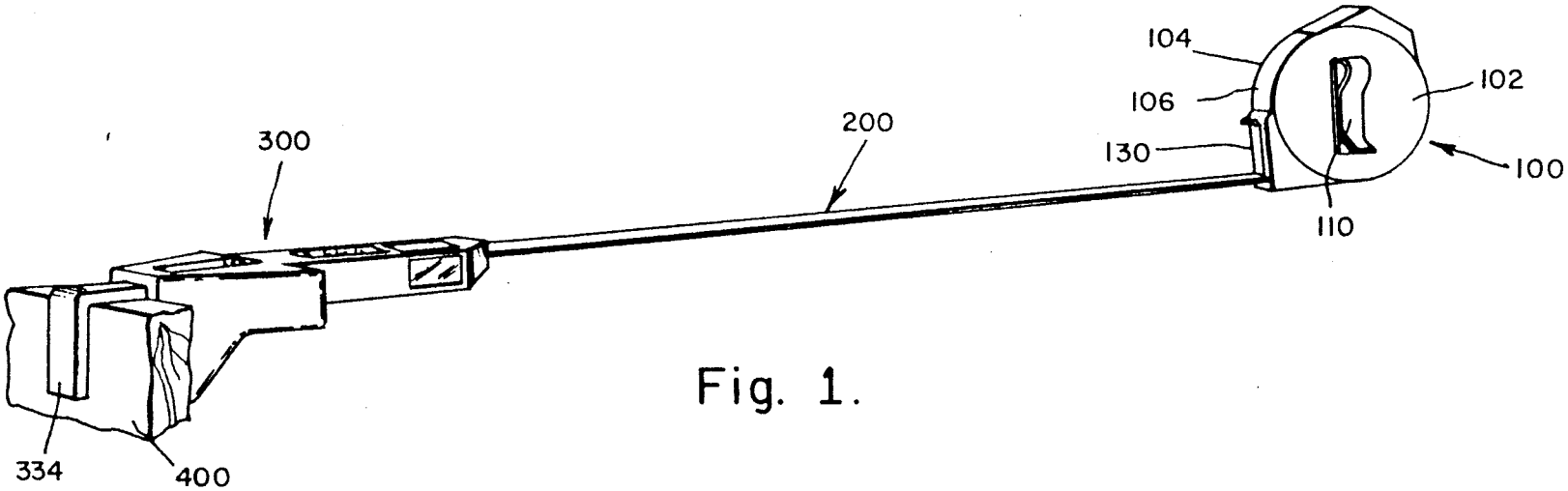
FIG. 1 is a perspective view of the present invention, a safety tracer for fire fighters, including an attaching means connected to an end of an elongated cord and which can be clamped to an object with the cord extending out from the housing of the safety tracer.

Referring to FIG. 1, there is illustrated a perspective view of the present invention safety tracer for fire fighters. There is shown a housing 100 of the safety tracer, an elongated retractable line 200 which preferably is a cord extending from housing 100, and an attaching means connected to a cord 200 at one end and clamped to an object 400. The line 200 can be a cord made out of fire retardant material or can be a line made out of metal or similar material. Housing 100 is generally disc shaped. It has two generally round shaped ends 102 and 104 and a circumferential side 106. It may be made of aluminum material or fire retardant plastic material. Cord 200 is made of fire retardant material and may be fifty feet long and color coded every ten feet. Attaching means 300 may be made of aluminum material or fire retardant plastic material.

Figure 2:
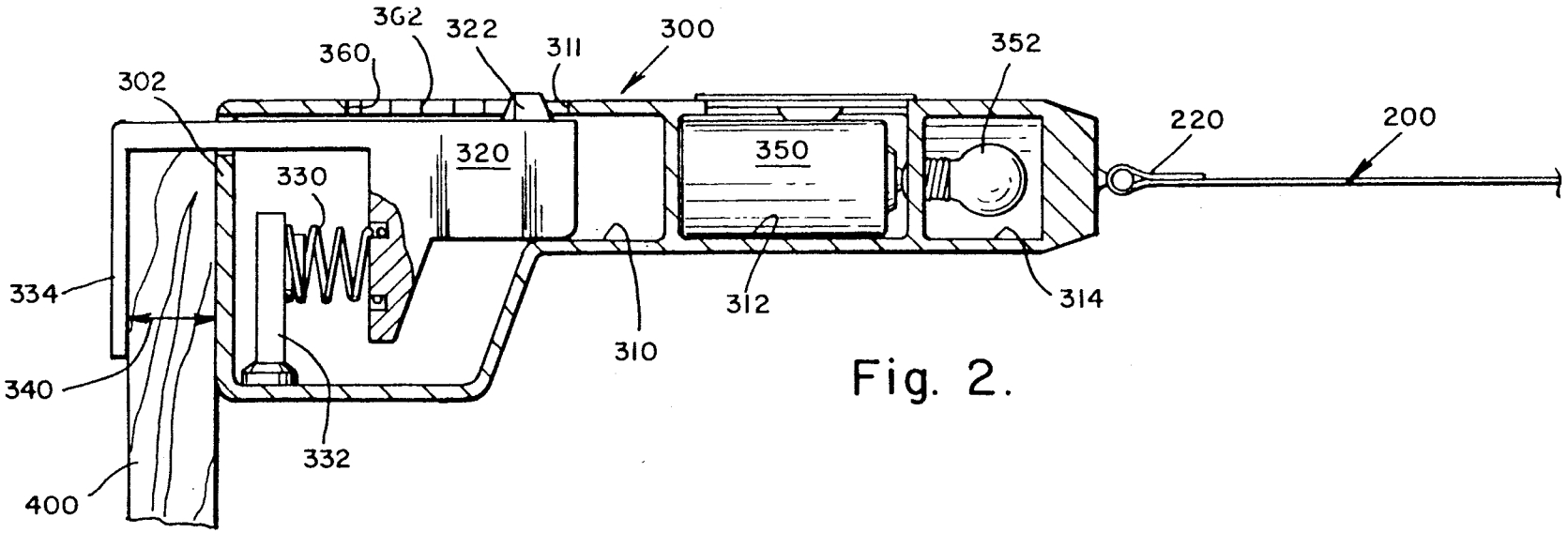
FIG. 2 is enlarged view of the attaching means connected to the end of the elongated cord.

Referring to FIG. 2, there is illustrated an enlarged view of attaching means 300 connected to an end 220 of cord 200. Attaching means 300 has three compartments, a major compartment 310 and two small compartments 312 and 314. A generally "U" shaped clamp 320 has its major body inside compartment 310 and its clamping arm 334 extended outward from body compartment 310. On top of clamp 320 there is a small knob 322 sticking out a little bit from a small top opening 311 of compartment 310. A spring 330 is attached at one end to clamp 320 and supported at the other end by a supporting piece 332 which is mounted inside compartment 310. Spring 330 tends to push clamp 320 back into a closing position where there is no gap between the clamping arm 334 of clamp 320 and the tip 302 of attaching means 300. By pushing knob 322 on clamp 320 in the direction toward end 302 to overcome the force of the spring, the spring clamp 320 can be opened so there is a gap 340 between the clamping arm 334 of clamp 320 and the tip 302 of attaching means 300. An object 400 such as a door hinge is inserted into gap 340 and the force on push knob 322 is then released so that clamping arm 334 traps the object 400 between the clamping arm 340 and tip 302 of clamp 320. A replaceable DC battery 350 is placed inside middle compartment 312, which provides voltage power to a replaceable light bulb 352 placed inside small compartment 314.

Figure 3:
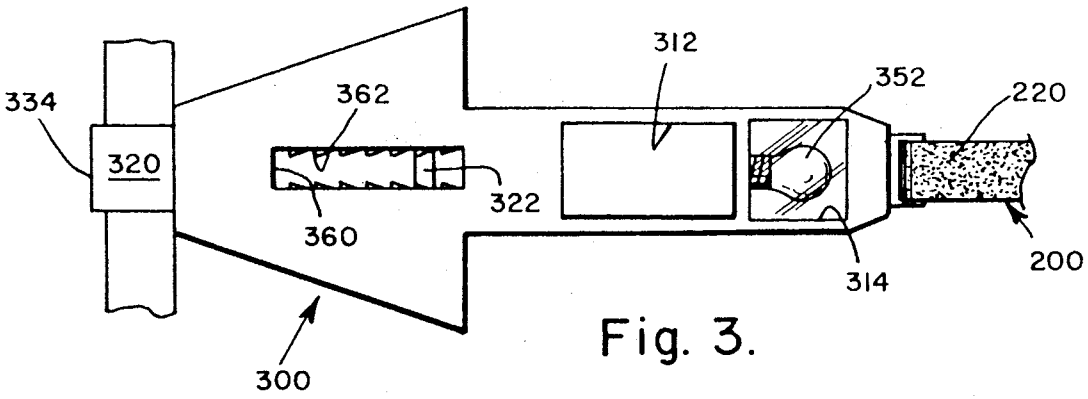
FIG. 3 is a top view of the attaching means connected to the end of the elongated cord.

Referring to FIG. 3, a top view of attaching means 300 shows that it is in the shape of a wedge. There is shown a small slot opening 360 on top of compartment 310 of attaching means 300. There are teeth 362 on the side of opening 360 so knob 322 may be locked into certain positions which in turn locks clamp 320 into an open position. The teeth 362 function as a lock to keep knob 322 at a specific location so that the clamp is in the opened position.

Figure 4:
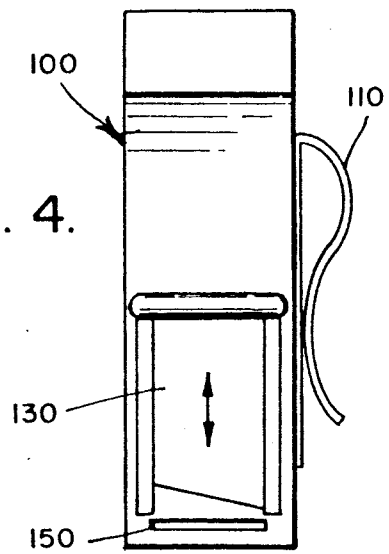
FIG. 4 is a side view of the housing of the safety tracer which shows a belt clip and a slide razor.

Referring to FIG. 4, there is illustrated a side view of housing 100. There is shown a belt clip 110 and a cutting means such as a slide razor 130. Below slide razor 130 there is an opening 150 in housing 100 so that retractable cord 200 can extend out from housing 100.

Figure 5:
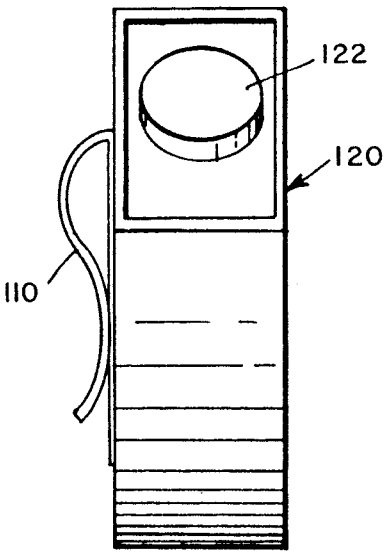
FIG. 5 is an opposite side view of the housing of the safety tracer which also shows a belt clip, and a button of a pager.

Referring to FIG. 5, there is illustrated an opposite side view of housing 100. In addition to belt clip 110, there is shown a radio transmitter 120 with a button 122.

Figure 6:
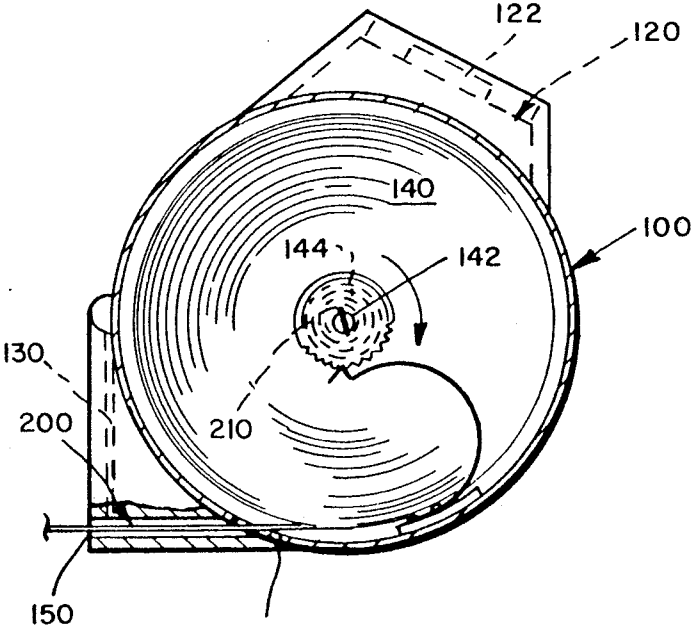
FIG. 6 is a side elevational view in partial cross-section, showing the interior of the central housing and also illustrating the pager and the slide razor.

Referring to FIG. 6, there is illustrated a side elevational view in partial cross-section of housing 100. There is shown a reel 140 pivoted with shaft 142 inside housing 100. A coiled spring 144 has one end attached to shaft 142 and the other end to reel 140 so it can make the reel rotate in a biasing direction. One end 220 of cord 200 is passed through opening 150, extends to outside of housing 100 and is connected to attaching means 300. The other end 210 of cord 200 is attached to reel 140. When reel 140 rotates in the biasing direction cord 200 is wound around reel 140. When cord 200 is pulling out from opening 150 of housing 100 it will unwind from around reel 140.

The present invention, a safety tracer for fire fighters provides many significant advantageous features. The light, compact safety tracer can be clipped on the waist belt of a fire fighter. Before the fire fighter enters a smoke filled house to conduct searching, he can quickly clamp the attaching means connected to the outside end of the cord to almost anything outside or at the entrance of the house, such as a tree, a fire hose, a door hinge or frame, or even a piece of furniture. When searching a specific room of a house, the clamp is clamped to the door leading to the room or to the door hinge. After the fire fighter enters the house to search for victims, or enters a specific room, as he moves further inside, the retractable fire retardant cord is unwound and extends out to serve as a tracing guide. The fifty foot cord is further coded in different colors every ten feet so the fire fighter can tell how far he has gone into the house or into the specific room. The attaching means is shaped as a wedge so when it is clamped to a door, or door hinge, it will keep the door open. There is also a light source on the attaching means so other fire fighters can tell at a glance that there is a fire fighter inside the room, and know that the room is being searched. If the fire fighter needs help or is in trouble he can use the pager to inform other fire fighters. When he decides to get out he can find his way back by following the extended cord even if he can not see through thick smoke. If on his way out the cord is tangled or caught on something, the fire fighter can always use the cutting means to out the cord loose so he can get out freely.

It should be pointed out that the present invention safety tracer can be also used by fire fighters working in high buildings as a supplementary safety device in addition to the heavy lifelines designed to support the full body weight of fire fighters because the present invention safety tracer is so small and light that there will not be any extra burden for a fire fighter to carry it. For instance a fire fighter can use a regular safety device descending himself from the roof of a building down to the burning level of a building and enter from a window. As soon as he safely gets to inside he can clamp the attaching means to the hinge or frame of the window. This will inform other fire fighters that this part of the floor is being searched. Other features of the tracer will also provide additional help to the fire fighter.

Defined in detail, the present invention is a safety tracer for fire fighters comprising: (a) a housing having an opening; (b) a belt clip mounted on said housing; (c) a reel pivoted inside said housing with a spring which makes the reel rotate in a biasing direction; (d) a fifty foot long fire retardant cord having a first end and a second end, where the first end is attached to said reel so the cord is wound around said reel when said reel rotates in said biasing direction, and the second end is passing through said opening of said housing so the cord can be unwound from around said reel and extended out from said housing; (e) a wedge shaped second attaching means connected to said second end of said cord having a clamp associated with a spring which keeps the clamp closed and a lock which keeps the clamp open, and a light source; (f) a radio transmitter mounted on said housing; and (g) a cutting means slide razor mounted on said housing near said opening.

In a preferred embodiment of the present invention the fifty foot long fire retardant cord is coded with different colors every ten feet, and the light source comprises a light bulb and a DC battery.

Defined broadly, the present invention is a safety tracer for fire fighters comprising: (a) a housing having an opening; (b) a first attaching means mounted on said housing; (c) a reel pivoted inside said housing with means making the reel rotate in a biasing direction; (d) an elongated cord having a first end and a second end, where the first end is attached to said reel so the cord is wound around said reel when said reel rotates in said biasing direction, and the second end is passing through said opening of said housing so the cord can be unwound from around said reel and extended out from said housing; (e) a second attaching means connected to said second end of said cord having a clamp associated with means keeping the clamp close and means keeping the clamp open, and a light source; (f) a paging means mounted on said housing; and (g) a cutting means mounted on said housing near said opening.

Defined more broadly, the present invention is a safety tracer for fire fighters comprising: (a) a housing having an opening; (b) a first attaching means mounted on said housing; (c) a reel pivoted inside said housing; (d) an elongated line having a first end and a second end, where the first end is attached to said reel so the cord can be wound around said reel; and the second end is passed through said opening of said housing so the cord can be unwound from around said reel and extended out from said housing; (e) a second attaching means connected to said second end of said cord, the second attaching means having a clamp and a light source.

In a preferred embodiment of the present invention the safety tracer further comprises a paging means mounted on the housing, and a cutting means mounted on the housing.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A safety tracer for fire fighters comprising:

a. a housing having an opening;

b. a first attaching means mounted on said housing for attaching said safety tracer to an object warn by a person using the safety tracer;

c. a reel pivoted inside said housing with means making the reel rotate in a biasing direction;

d. an elongated line having a first end and a second end, where the first end is attached to said reel so the line is wound around said reel when said reel rotates in said biasing direction, and the second end is passed through said opening of said housing so the line can be unwound from around said reel and extended out from said housing;

e. a second attaching means connected to said second end of said line, the second attaching means having a clamp including means for keeping the clamp closed and means for keeping the clamp open, and a light source;

f. a paging means mounted on said housing; and g. a cutting means mounted on said housing near said opening.

2. The invention as defined in claim 1 wherein said first attaching means is a belt clip.

3. The invention as defined in claim 1 wherein said elongated line is made of fire retardant material.

4. The invention as defined in claim 1 wherein said line is a cord.

5. The invention as defined in claim 4 wherein said elongated cord is fifty feet long.

6. The invention as defined in claim 5 wherein said elongated cord is coded with different colors every ten feet.

7. The invention as defined in claim 1 wherein said second attaching means is shaped as a wedge.

8. The invention as defined in claim 1 wherein said light source comprises a light bulb and a DC battery.

9. The invention as defined in claim 1 wherein said paging means is a radio transmitter.

10. The invention as defined in claim 1 wherein said cutting means is a slide razor.

11. A safety tracer for fire fighters comprising:

a. a housing having an opening;

b. a belt clip mounted on said housing;

c. a reel pivoted inside said housing with a spring which makes the reel rotate in a biasing direction;

d. a fifty foot long fire retardant cord having a first end and a second end, where the first end is attached to said reel so the cord is wound around said reel when said reel rotates in said biasing direction, and the second end is passing through said opening of said housing so the cord can be unwound from around said reel and extended out from said housing;

e. a wedge shaped second attaching means connected to said second end of said cord having a clamp associated with a spring which keeps the clamp close and a lock which keeps the clamp open, and a light source;

f. a radio transmitter mounted on said housing; and g. a slide razor mounted on said housing near said opening.

12. The invention as defined in claim 11 wherein said fifty foot long fire retardant cord is coded with different colors every ten feet.

13. The invention as defined in claim 11 wherein said light source comprises a light bulb and a DC battery.

* * * * *